US012721432B2

(12) United States Patent
Isele

(10) Patent No.: US 12,721,432 B2
(45) **Date of Patent: *Sep. 1, 2026**

(54) DRAWER PULL-OUT GUIDE

(71) Applicant: Julius Blum GmbH, Hoechst (AT)

(72) Inventor: Olaf Isele, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 62 days.

This patent is subject to a terminal disclaimer.

(21) Appl. No.: 18/417,435

(22) Filed: Jan. 19, 2024

(65) Prior Publication Data

US 2024/0180327 A1 Jun. 6, 2024

Related U.S. Application Data

(63) Continuation of application No. PCT/AT2022/060252, filed on Jul. 15, 2022.

(30) Foreign Application Priority Data

Jul. 23, 2021 (AT) ..... 50610/2021

(51) Int. Cl.
*A47B 88/487* (2017.01)

(52) U.S. Cl.
CPC ..... *A47B 88/487* (2017.01)

(58) Field of Classification Search
CPC ..... A47B 88/493; A47B 88/487; A47B 2210/0021
See application file for complete search history.

(56) References Cited

U.S. PATENT DOCUMENTS

| | | | | |
|---|---|---|---|---|
| 4,955,160 | A | 9/1990 | Röck | |
| 5,344,228 | A * | 9/1994 | Kovarik | A47B 88/493 312/334.17 |
| 6,854,816 | B2 | 2/2005 | Milligan | |
| 7,562,950 | B2 | 7/2009 | Lam et al. | |
| 7,690,740 | B2 * | 4/2010 | Blum | A47B 88/493 312/334.33 |

(Continued)

FOREIGN PATENT DOCUMENTS

| | | |
|---|---|---|
| AT | 518049 | 7/2017 |
| CN | 202820340 | 3/2013 |

(Continued)

OTHER PUBLICATIONS

International Search Report issued Oct. 13, 2022 International (PCT) Application No. PCT/AT2022/060252.

(Continued)

*Primary Examiner* — Bradley Duckworth
(74) *Attorney, Agent, or Firm* — Wenderoth, Lind & Ponack, L.L.P.

(57) ABSTRACT

A drawer pull-out guide includes a carcass rail to be fixed to a furniture carcass, and a drawer rail to be connected to a drawer. The drawer rail is displaceably supported relative to the carcass rail in a longitudinal direction. The drawer rail or the carcass rail, in a cross section extending perpendicular to the longitudinal direction, includes a profile defined by a flat sheet metal having two longitudinal edges extending parallel to each other. The profile of the drawer rail or the carcass rail, on at least one longitudinal edge, includes a foldover having at least a doubled material thickness.

20 Claims, 3 Drawing Sheets

(56) References Cited

U.S. PATENT DOCUMENTS

| | | | | |
|---|---|---|---|---|
| 8,678,529 | B2 | 3/2014 | Li | |
| 8,888,202 | B2 | 11/2014 | Johansson | |
| 9,095,213 | B2 | 8/2015 | Park et al. | |
| 9,155,386 | B2 * | 10/2015 | Hashemi | A47B 88/493 |
| 9,204,722 | B2 * | 12/2015 | Violand | A47B 88/437 |
| 9,784,314 | B2 * | 10/2017 | Ng | F16C 33/48 |
| 9,993,857 | B2 * | 6/2018 | Schneider | B21B 1/24 |
| 10,159,344 | B2 | 12/2018 | Mason et al. | |
| 10,314,398 | B2 | 6/2019 | Bowman et al. | |
| 10,362,869 | B2 | 7/2019 | Gasser et al. | |
| 10,568,424 | B2 * | 2/2020 | Meusburger | A47B 88/487 |
| 2003/0071548 | A1 | 4/2003 | Milligan | |
| 2006/0214548 | A1 | 9/2006 | Lam et al. | |
| 2010/0026154 | A1 | 2/2010 | Johansson | |
| 2011/0188788 | A1 | 8/2011 | Li | |
| 2011/0241515 | A1 | 10/2011 | Park et al. | |
| 2017/0172300 | A1 | 6/2017 | Bowman et al. | |
| 2018/0055224 | A1 | 3/2018 | Mason et al. | |
| 2018/0271274 | A1 | 9/2018 | Gasser et al. | |
| 2019/0166994 | A1 | 6/2019 | Rihtarec | |
| 2020/0187648 | A1 * | 6/2020 | Meusburger | F16C 29/008 |
| 2021/0022498 | A1 * | 1/2021 | Zhan | A47B 88/437 |
| 2023/0380593 | A1 * | 11/2023 | Lee | F16C 29/048 |
| 2024/0149319 | A1 * | 5/2024 | Isele | B21D 19/005 |
| 2024/0156258 | A1 * | 5/2024 | Isele | A47B 88/43 |
| 2024/0156260 | A1 * | 5/2024 | Isele | A47B 88/483 |
| 2024/0164521 | A1 * | 5/2024 | Sutterluetti | A47B 88/423 |

FOREIGN PATENT DOCUMENTS

| | | |
|---|---|---|
| CN | 107752492 | 3/2018 |
| CN | 108430268 | 8/2018 |
| DE | 20 2009 003 459 | 8/2010 |
| DE | 10 2016 125 028 | 6/2017 |
| EP | 0 363 583 | 4/1990 |
| EP | 2 168 454 | 3/2010 |
| EP | 2 241 218 | 10/2010 |
| EP | 2 429 340 | 8/2013 |
| JP | 60-8655 | 1/1985 |
| WO | 2004/103119 | 12/2004 |

OTHER PUBLICATIONS

Xuuyuu Sliding Rail, Drawer Slide, Drawer Rail, Maximum Load: 33.1-44.2 lbs (15-20 kg), Telescopic, 13.5 inches (342 mm), 2 Tiers, 0.7 inch (17 mm) Thick, High Hardness Cold Rolled Steel Sheet, Amazon, Jul. 28, 2020, URL: https://x.gd/oDpaE, with English Translation.

* cited by examiner

DRAWER PULL-OUT GUIDE

The present application is a continuation of International Application PCT/AT2022/060252, filed Jul. 15, 2022. Thus, all of the subject matter of International Application PCT/AT2022/060252 is incorporated herein by reference.

BACKGROUND OF THE INVENTION

The present invention relates to a drawer pull-out guide for movably supporting a drawer on a furniture carcass. The drawer pull-out guide includes a carcass rail configured to be fixed to the furniture carcass, and at least one drawer rail configured to be connected to the drawer. The at least one drawer rail is displaceably supported relative to the carcass rail in a longitudinal direction, and optionally at least one central rail is arranged between the carcass rail and the drawer rail. At least one of the rails, preferably the carcass rail, the central rail, and/or the at least one drawer rail, in a cross-section extending perpendicular to the longitudinal direction, includes at least one profile formed by at least one flat sheet metal having two longitudinal edges extending parallel to each other.

Moreover, the invention relates to a drawer sidewall with a drawer pull-out guide of the type to be described, and with a hollow-chamber profile which is connected or which is configured to be connected to the at least one drawer rail of the drawer pull-out guide.

The rails of a drawer pull-out guide are frequently produced by a flat sheet metal which is processed to a profiled rail by a subsequent bending operation and/or sheet forming operation. By virtue of the finished profiles, the loads of the drawer pull-out guide can be absorbed in a horizontal and in a vertical direction. As a result, the drawer connected to the drawer pull-out guide can be stably guided.

A general problem is the requirement for metal which is necessary for producing a drawer pull-out guide. A high material usage leads to a high weight and to increased costs in serial production. Therefore, it is desirable to employ metal as few as possible, particularly because a resource-saving use of raw materials creates both ecological and economic benefits.

EP 0 363 583 A1 discloses a drawer-pull out guide in which a central rail is displaceably supported between the carcass rail and the extension rail. The central rail, in a cross-section, includes two lateral running limbs for the rolling support of running rollers. Each of the lateral running limbs of the central rail is formed by a foldover having a doubled material thickness. A drawback is the fact that the bending operation for producing the central rail is relatively elaborate.

SUMMARY OF THE INVENTION

It is an object of the present invention to propose a drawer pull-out guide of the type mentioned in the introductory part, thereby avoiding the drawbacks as discussed above.

According to the invention, the profile of the at least one rail, on at least one longitudinal edge, preferably on both longitudinal edges, includes at least one foldover having at least a doubled material thickness.

In other words, the profile of the carcass rail and/or the profile of the drawer rail and/or the profile of the central rail, on at least one longitudinal edge, preferably on both longitudinal edges, includes or include a foldover having at least a doubled material thickness. As a result, a simple bending operation of the sheet metal can be made possible on the one hand. On the other hand, the stiffness of the profile can be increased in a region of the foldover. Moreover, a rounded edge is formed by the foldover, and the rounded edge reduces the risk of injury instead of having a sharp longitudinal edge.

A particular advantage of the invention lies in the fact that thinner sheet metals than usual can be used for producing the drawer pull-out guide (thus, for example, sheet metals having a thickness of 0.7 mm instead of sheet metals having a thickness of 1.5 mm). By virtue of the at least one foldover, the stiffness of the carcass rail and/or of the drawer rail and/or of the central rail can be increased in the areas which are subjected to high stresses. The areas that are subjected to high stresses are, in particular, the running tracks of the carcass rail and/or of the drawer rail and/or of the central rail on which rolling bodies (in particular rolling bodies of the running carriage) can roll along.

Under the exemplary assumption that a thinner sheet metal with 0.7 mm is used, the areas which are subjected to high stresses thus receive a thickness of 1.4 mm due to the foldover. Due to the durable running tracks, the rolling bodies can be optimally guided along the rails. On the contrary, the remaining areas of the rails which are not subjected to large loads can be formed with a single, reduced material thickness (thus with a thickness of 0.7 mm). By these measures, the material usage, the weight and the costs for producing the drawer pull-out guide can be significantly reduced.

According to an embodiment, the drawer pull-out guide includes at least one rolling body which is displaceable at least over a region in the longitudinal direction along the at least one foldover.

Preferably, it can be provided that:

- at least one running carriage is provided, the running carriage being arranged between the carcass rail and the at least one drawer rail, and at least one rolling body is arranged in the running carriage, and/or
- at least one rolling body is provided, the rolling body being rotationally supported about a rotational axis, and the rotational axis of the rolling body is aligned in a direction extending transversely to a longitudinal edge.

BRIEF DESCRIPTION OF THE DRAWINGS

Further details and advantages of the present invention result from the following description of figures, in which.

DETAILED DESCRIPTION OF THE INVENTION

Figure 1A:
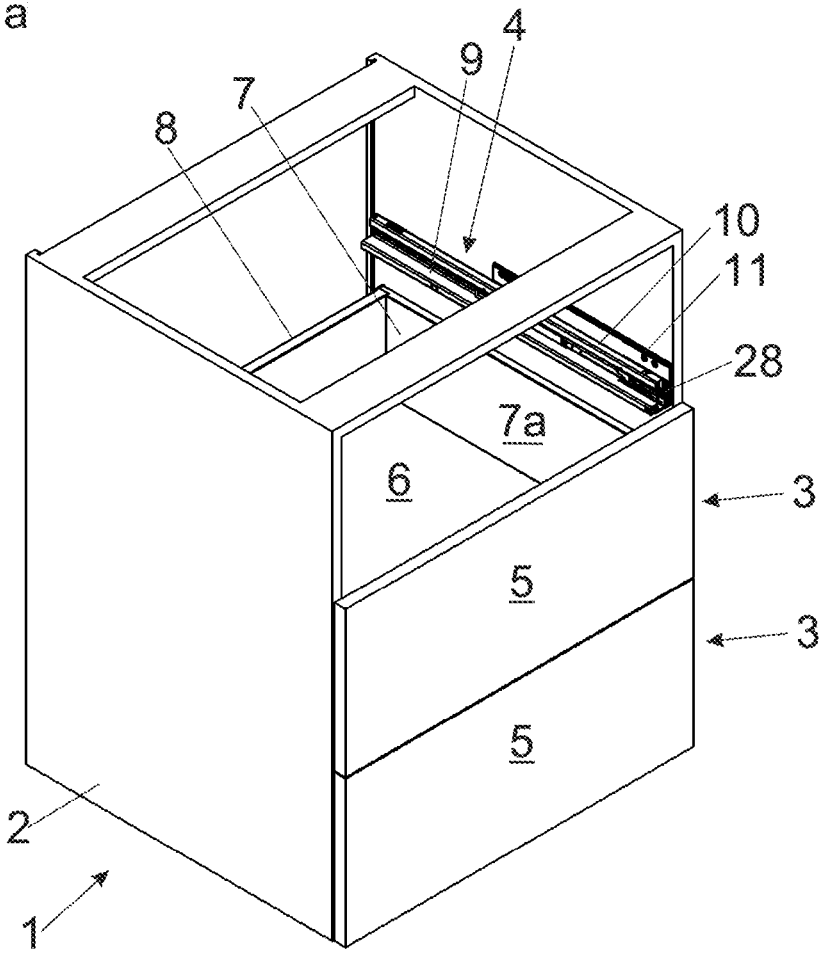
FIG. 1*a*, 1*b* show an item of furniture with drawers and a drawer pull-out guide in perspective views.

FIG. 1*a* shows a perspective view of an item of furniture 1 comprising a furniture carcass 2, in which drawers 3 are displaceably supported relative to the furniture carcass 2 via drawer pull-out guides 4. For the sake of improved overview, the uppermost drawer 3 is not depicted. Each of the drawers 3 includes a front panel 5, a drawer bottom 6, drawer sidewalls 7 and a rear wall 8.

The drawer pull-out guides 4 include a carcass rail 9 configured to be fixed to the furniture carcass 2 via a fastening portion 11. Further, at least one drawer rail 10 is provided, the at least one drawer rail 10 being configured to be connected to the drawer 3 and being displaceably supported relative to the stationary carcass rail 9.

If appropriate, the drawer pull-out guide 4 can also include a central rail 28 which is displaceable between the carcass rail 9 and the drawer rail 10, thereby allowing the drawer 3 to be fully extended relative to the furniture carcass 2.

Each of the drawer sidewalls 7 can include a hollow-chamber profile 7*a* which is connected or which is configured to be connected to the at least one drawer rail 10 of the drawer pull-out guide 4.

Figure 1B:
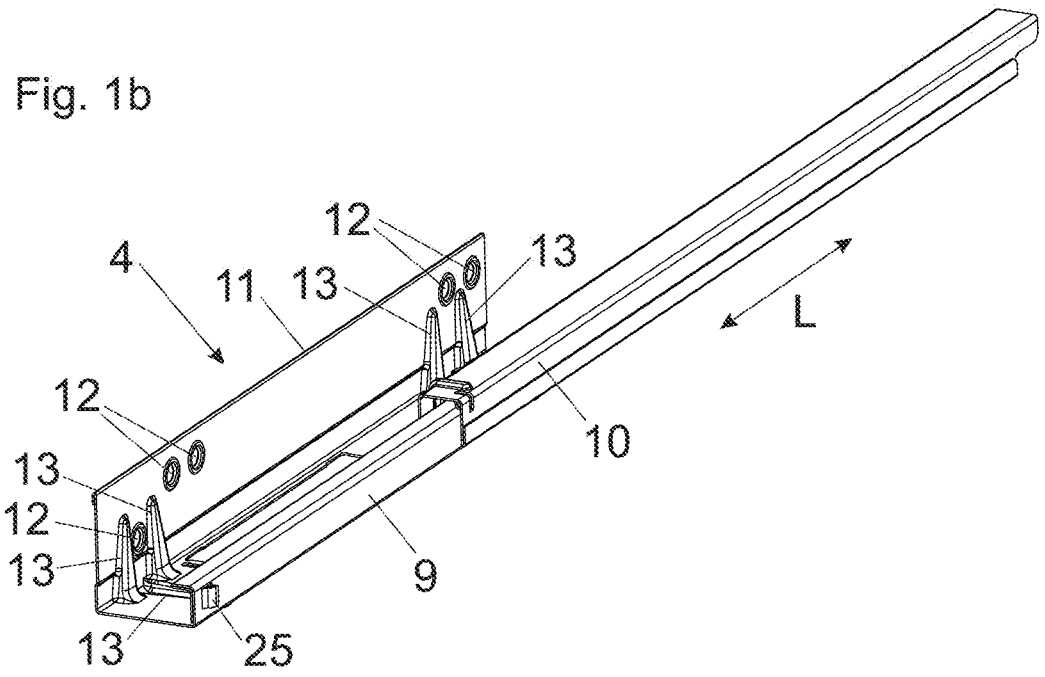

FIG. 1*b* shows the drawer pull-out guide 4 in a perspective view, in which the carcass rail 9 to be fixed to the furniture carcass 2 and the drawer rail 10 displaceable in the longitudinal direction (L) can be seen. The carcass rail 9 is to be fixed to the furniture carcass 2 via a fastening portion 11.

The fastening portion 11 can include at least one, preferably circular, opening 12 for the passage of a screw so as to screw the fastening portion 11 to the furniture carcass 2.

Each of the fastening portion 11, the carcass rail 9 and the drawer rail 10 can have at least one reinforcement bead 13. At least one opening 12 for the passage of a screw can be arranged between two reinforcement beads 13. As a result, the resistance moment can be increased in this area.

Figure 2A:
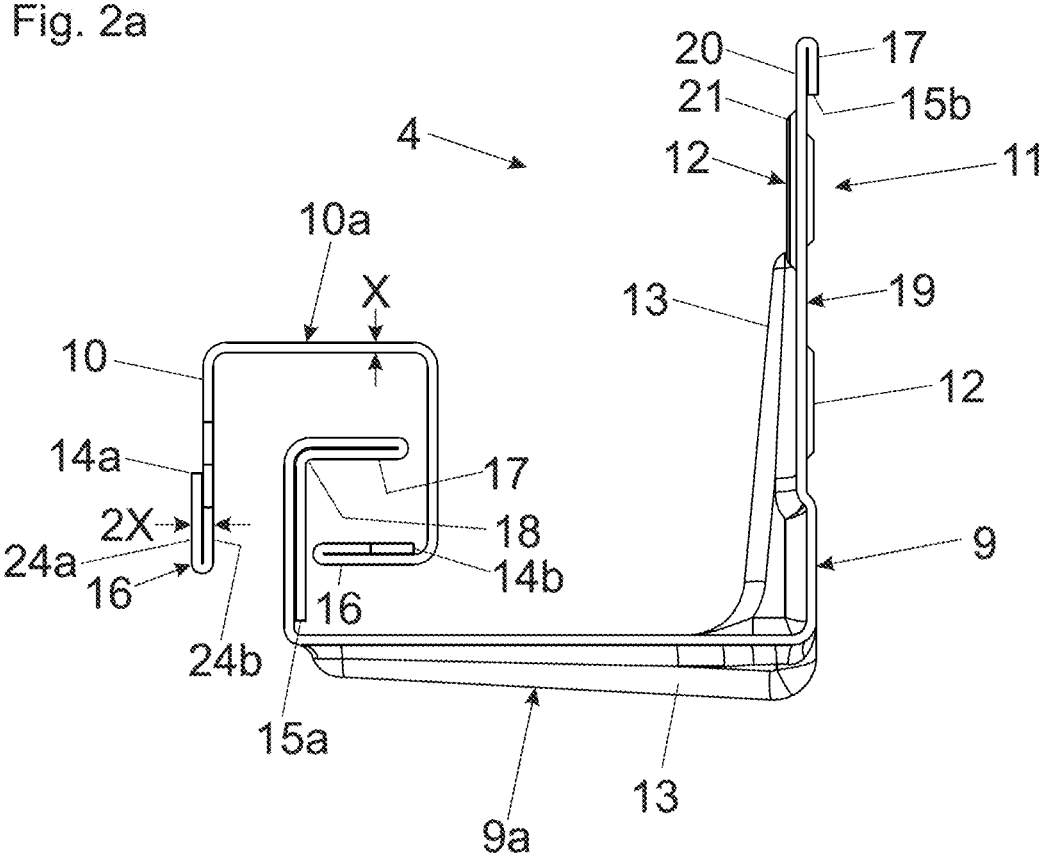
FIG. 2*a*, 2*b* show a cross-sectional view of the drawer pull-out guide with unfitted and with fitted rolling bodies.

FIG. 2*a* shows the drawer pull-out guide 4 in a cross-sectional view extending perpendicular to the longitudinal direction (L). The carcass rail 9 to be fixed to the furniture carcass 2 and the drawer rail 10 displaceable relative to the carcass rail 9 can be seen.

The fastening portion 11 of the carcass rail 9 has a fastening side 19 configured to at least partially bear against the furniture carcass 2 when the carcass rail 9 is mounted to the furniture carcass 2.

The carcass rail 9 and/or the drawer rail 10 is or are bent to a profile 9*a*, 10*a* from a flat sheet metal having two longitudinal edges 14*a*, 14*b* (drawer rail 10) and 15*a*, 15*b* (carcass rail 9). The flat sheet metal has a material thickness (X).

The flat sheet metal, from which the profile 9*a*, 10*a* is formed, can have, for example, a material thickness (X) of between 0.5 mm and 1.0 mm, preferably a material thickness (X) of 0.7 mm.

The profile 9*a* of the carcass rail 9 and/or the profile 10*a* of the drawer rail 10 includes or include at least one foldover 16, 17 having at least a doubled material thickness (2X) on at least one longitudinal edge 14*a*, 14*b*, 15*a*, 15*b*, preferably on both longitudinal edges 14*a*, 14*b*, 15*a*, 15*b*. Preferably, the at least one foldover 16, 17 has precisely a doubled material thickness (2X).

If appropriate, the foldover 16, 17 can also be folded three times or multiple times so as to obtain a triple or a multiple material thickness (X).

At least one foldover 16, 17 can be arranged on a longitudinal edge 15*b* of the carcass rail 9, and this foldover 16, 17 is configured to bear against the furniture carcass 2 when the carcass rail 9 is mounted to the furniture carcass 2.

According to an embodiment, the at least one foldover 16, 17, on the at least one longitudinal edge 14*a*, 14*b*, 15*a*, 15*b*, includes at least two sheet metal portions 24*a*, 24*b* bearing at least partially against each other.

The at least one drawer rail 10, on both longitudinal edges 14*a*, 14*b*, can have at least one foldover 16, 17 having at least a doubled material thickness (2X). The two foldovers 16, 17 are aligned transversely, preferably substantially perpendicular, to each other, and/or one of the two foldovers 16, 17 faces towards the inside and the other of the two foldovers 16, 17 faces towards the outside.

At least one foldover 16, 17, on the at least one longitudinal edge 14*a*, 14*b*, 15*a*, 15*b* and in a cross-section extending perpendicular to the longitudinal direction (L), includes at least one kink 18 extending in the longitudinal direction (L). Preferably, the at least one foldover 16, 17 is formed on the at least one longitudinal edge 15*a* of the carcass rail 9.

The carcass rail 9 can include at least one fastening portion 11 having a fastening side 19, the fastening side 19 being configured to at least partially bear against the furniture carcass 2 when the carcass rail 9 is mounted to the furniture carcass 2.

The at least one fastening portion 11 can have at least one, preferably circular, opening 12 for the passage of a fastener, preferably of a screw.

According to an embodiment, the at least one opening 12, on a second side 20 spaced apart from the fastening side 19 by a material thickness (X) of the fastening portion 11, is surrounded by a bulge 21, the bulge 21 projecting transversely from the second side 20.

By virtue of the bulge 21 surrounding the opening 12, the stiffness of the fastening portion 11 can be significantly increased in a region of the opening 12. This is, in particular, advantageous when sheet metals with a thinner material thickness (X) are employed.

At least one reinforcement bead 13 can have a longitudinal direction extending transversely to the longitudinal direction (L) of the carcass rail 9. At least one reinforcement bead 13 or a plurality of reinforcement beads 13 can be arranged on the vertical limb of the fastening portion 11 and/or on the transverse limb of the fastening portion 11.

Figure 2B:
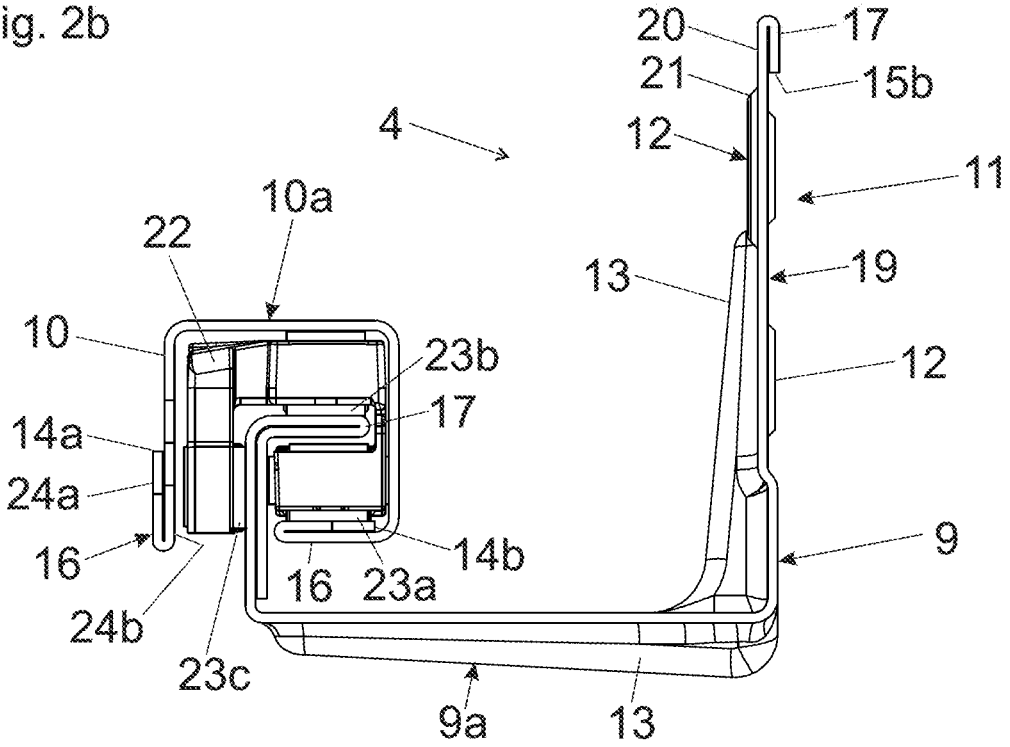

FIG. 2*b* shows the drawer pull-out guide 4 according to FIG. 2*a* in a cross-sectional view with fitted rolling bodies 23*a*, 23*b*, 23*c*.

Preferably, the rolling bodies 23*a*, 23*b*, 23*c* are supported in a common running carriage 22, the running carriage 22 being displaceably supported between the carcass rail 9 and the at least one drawer rail 10.

According to possible embodiments, at least one rolling body 23*a* is rotatable about a horizontal axis in the mounted position and is displaceable along the foldover 16 of the drawer rail 10.

At least one further rolling body 23*b* is rotatable about a horizontal axis in the mounted position and is displaceable along the foldover 17 of the carcass rail 9.

At least one further rolling body 23*c* is rotatable about a vertical axis in the mounted position and is displaceable along a portion of the carcass rail 9 having a doubled material thickness (2X).

Figure 3A:
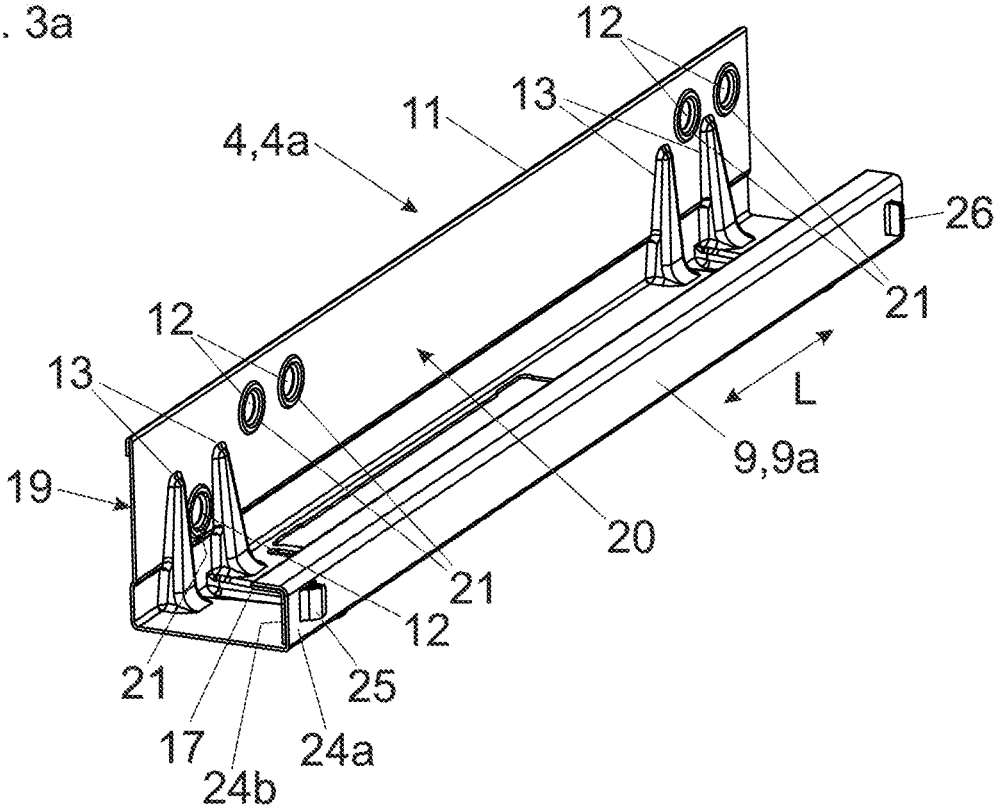
FIG. 3*a*, 3*b* show the carcass rail of the drawer pull-out guide in a perspective view and in a cross-sectional view.

FIG. 3*a* shows the profile 9*a* of the carcass rail 9 in a perspective view. The fastening portion 11 for fixing the carcass rail 9 includes a fastening side 19 configured to bear against the furniture carcass 2. On the fastening portion 11, at least one opening 12 for the passage of a fastener, in particular a screw, for fixing the carcass rail 9 to the furniture carcass 2 is arranged.

The at least one opening 12, on a second side 20 spaced apart from the fastening side 19 by a material thickness (X), is surrounded by a bulge 21, the bulge 21 projecting transversely from the second side 20 of the fastening portion 11. The head of a screw for fixing the fastening portion 11 to the furniture carcass 2 is at least partially, preferably substantially entirely, received within the annular bulge 21 in a mounted condition.

The sheet metal portions 24*a*, 24*b* of the foldover 16, 17 bearing against each other are connected to each other by at least one common punch 25, 26. In this way, the foldover 16, 17 can be additionally stabilized.

According to an embodiment, two punches 25, 26 are provided, the punches 25, 26 being spaced apart from each other in the longitudinal direction (L).

According to preferred embodiments, it can be provided that the at least one punch 25, 26 is arranged on an end of the profile 9*a* of the carcass rail 9 and/or of the profile 10*a* of the at least one drawer rail 10, and/or at least two common punches 25, 26 are provided, preferably wherein the at least two punches 25, 26 are configured to be mirror inverted to each other, and/or at least one running carriage 22 (FIG. 2*b*) is provided, and the at least one punch 25, 26 forms an abutment configured to limit a travel path of the at least one running carriage 22, and/or the at least one punch 25, 26 is configured as an angled tab.

The at least one punch 25, 26 can thus perform a dual function. On the one hand, the punch 25, 26 serves for stabilizing the sheet metal portions 24*a*, 24*b* of the foldover 16, 17 bearing against each other. On the other hand, the laterally projecting punch 25, 26 is provided for limiting a travel path of the running carriage 22 in the longitudinal direction (L). By virtue of the punch 25, 26, the running carriage 22 receives a defined end position and can thus not ride beyond an end of the carcass rail 9 and/or of the at least drawer rail 10.

Figure 3B:
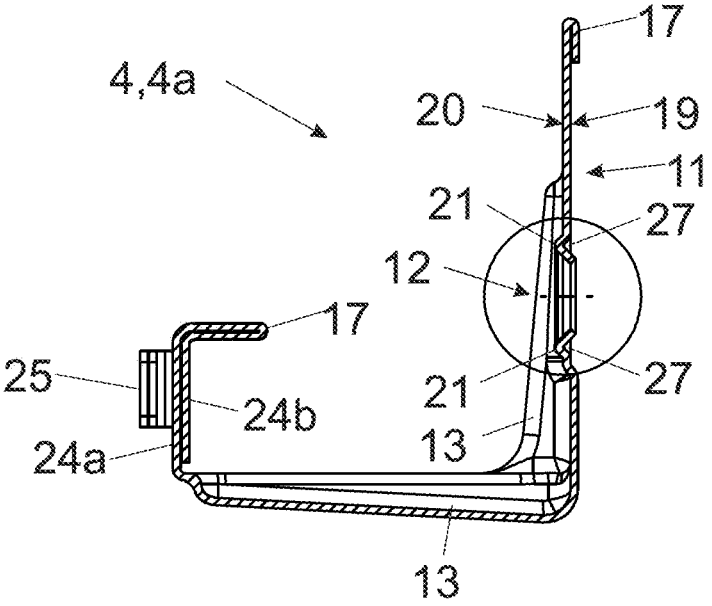

FIG. 3*b* shows the drawer pull-out guide 4 according to FIG. 3*a* in a cross-sectional view. On the fastening side 19 of the fastening portion 11 and adjacent to the at least one opening 12, at least one recess 27 for partially receiving accruing chip material is arranged. In this way, an undesired lifting of the fastening portion 11 from the furniture carcass 2 can be prevented when the fastening portion 11 is screwed to the furniture carcass 2.

The invention claimed is:

1. A drawer pull-out guide for movably supporting a drawer on a furniture carcass, the drawer pull-out guide comprising:

a carcass rail configured to be fixed to the furniture carcass; and a drawer rail configured to be connected to the drawer, the drawer rail being displaceably supported relative to the carcass rail in a longitudinal direction, wherein:

the carcass rail or the drawer rail, in a cross section extending perpendicular to the longitudinal direction, includes at least one profile defined by at least one flat sheet metal having two longitudinal edges extending parallel to each other;

the at least one profile of the carcass rail or the drawer rail, on at least one longitudinal edge, includes at least one foldover having at least a doubled material thickness;

at least one recess is defined on a fastening side of a fastening portion of the carcass rail and adjacent to at least one opening of the fastening portion of the carcass rail; and the at least one recess has a symmetrical annular shape defined around the at least one opening of the fastening portion of the carcass rail.

2. The drawer pull-out guide according to claim 1, further comprising at least one rolling body which is displaceable at least over a region along the at least one foldover in the longitudinal direction.

3. The drawer pull-out guide according to claim 1, further comprising:

at least one running carriage which is between the carcass rail and the drawer rail; or at least one rolling body which is rotatably supported about a rotational axis which is aligned transversely to the at least one longitudinal edge.

4. The drawer pull-out guide according to claim 1, wherein the at least one foldover is on the at least one longitudinal edge of the carcass rail, and the at least one foldover is configured to bear against the furniture carcass when the carcass rail is mounted.

5. The drawer pull-out guide according to claim 1, wherein the at least one foldover is formed by edging or bending.

6. The drawer pull-out guide according to claim 1, wherein the at least one foldover includes at least two sheet metal portions bearing at least partially against each other.

7. The drawer pull-out guide according to claim 6, wherein the at least two sheet metal portions include at least one common punch.

8. The drawer pull-out guide according to claim 7, wherein:

the at least one common punch is on an end of the at least one profile of the carcass rail or the drawer rail; or the drawer pull-out guide further comprises at least one running carriage, and the at least one common punch defines an abutment configured to limit a travel path of the at least one running carriage, or the at least one common punch is configured as an angled tab.

9. The drawer pull-out guide according to claim 1, wherein the at least one flat sheet metal has a material thickness of between 0.5 mm and 1.0 mm.

10. The drawer pull-out guide according to claim 1, wherein:

the at least one foldover includes two foldovers on respective longitudinal edges of the drawer rail; and the two foldovers are aligned transversely to each other, or a first of the two foldovers faces towards a first direction and a second of the two foldovers faces towards a second direction.

11. The drawer pull-out guide according to claim 1, wherein the at least one foldover, in the cross section extending perpendicular to the longitudinal direction, includes at least one kink extending in the longitudinal direction.

12. The drawer pull-out guide according to claim 1, wherein the fastening side of the fastening portion of the carcass rail is configured to bear at least partially against the furniture carcass when the carcass rail is mounted to the furniture carcass.

13. The drawer pull-out guide according to claim 12, wherein the at least one opening of the fastening portion of the carcass rail, on a second side spaced apart from the fastening side by a material thickness of the fastening portion of the carcass rail, is surrounded by a bulge projecting transversely from the second side.

14. The drawer pull-out guide according to claim 1, wherein the fastening side of the fastening portion of the carcass rail is configured to bear at least partially against the furniture carcass when the carcass rail is mounted to the furniture carcass, the at least one foldover is on the at least one longitudinal edge of the carcass rail, and the at least one foldover is configured to bear against the furniture carcass.

15. The drawer pull-out guide according to claim 1, further comprising:

a central rail between the carcass rail and the drawer rail.

16. The drawer pull-out guide according to claim 1, wherein:

the carcass rail is formed of only one single flat sheet metal;

the carcass rail includes the at least one profile;

the at least one profile is defined by the only one single flat sheet metal; and the at least one foldover is configured to bear against the furniture carcass.

17. The drawer pull-out guide according to claim 1, wherein:

the carcass rail includes a first reinforcement bead and a second reinforcement bead;

exactly one opening is defined in the carcass rail between the first reinforcement bead and the second reinforcement bead; and the exactly one opening, on a second side spaced apart from a fastening side by a material thickness of a fastening portion of the carcass rail, is surrounded by a bulge projecting transversely from the second side.

18. The drawer pull-out guide according to claim 1, further comprising at least one rolling body, wherein:

the at least one foldover, in the cross section extending perpendicular to the longitudinal direction, includes at least one kink extending in the longitudinal direction;

the at least one kink has the at least the doubled material thickness; and the at least one rolling body is displaceable at least over a region along the at least one foldover in the longitudinal direction.

19. A drawer sidewall comprising:

the drawer pull-out guide according to claim 1, wherein the drawer sidewall has a hollow-chamber profile which is connected or configured to be connected to the drawer rail.

20. A drawer pull-out guide for movably supporting a drawer on a furniture carcass, the drawer pull-out guide comprising:

a carcass rail configured to be fixed to the furniture carcass; and a drawer rail configured to be connected to the drawer, the drawer rail being displaceably supported relative to the carcass rail in a longitudinal direction, wherein:

the carcass rail or the drawer rail, in a cross section extending perpendicular to the longitudinal direction, includes at least one profile defined by at least one flat sheet metal having two longitudinal edges extending parallel to each other;

the at least one profile of the carcass rail or the drawer rail, on at least one longitudinal edge, includes at least one foldover having at least a doubled material thickness;

the carcass rail includes a first reinforcement bead, a second reinforcement bead and a third reinforcement bead;

the first reinforcement bead and the second reinforcement bead are on a vertical limb of the carcass rail;

the third reinforcement bead is on a horizontal limb of the carcass rail; and the third reinforcement bead is between the first reinforcement bead and the second reinforcement bead.

* * * * *